United States Patent [19]

Jackson

[11] 4,078,587

[45] Mar. 14, 1978

[54] NON-PREMIX GAS BURNER ORIFICE

[76] Inventor: Samuel G. Jackson, P.O. Box 16587, Lubbock, Tex. 79490

[21] Appl. No.: 722,340

[22] Filed: Sep. 10, 1976

[51] Int. Cl.[2] ..... B05B 1/14

[52] U.S. Cl. ..... 239/552; 239/568; 431/352

[58] Field of Search ..... 432/222; 239/552, 555, 239/568, DIG. 7; 431/352, 116

[56] References Cited

U.S. PATENT DOCUMENTS

| | | | |
|---|---|---|---|
| 794,225 | 7/1905 | Humphrey | 239/552 |
| 1,016,869 | 2/1912 | Beckfield | 239/555 |
| 1,739,515 | 12/1929 | Mustee | 239/552 |
| 2,797,745 | 7/1957 | Rowell | 431/78 |
| 3,064,720 | 11/1962 | Keating et al. | 432/222 |

FOREIGN PATENT DOCUMENTS

| | | | |
|---|---|---|---|
| 567,748 | 1/1933 | Germany | 239/555 |
| 892,067 | 3/1962 | United Kingdom | 239/555 |

*Primary Examiner*—Carroll B. Dority, Jr.
*Attorney, Agent, or Firm*—Clarence A. O'Brien; Harvey B. Jacobson

[57] ABSTRACT

A multiple-jet orifice for the gas burner of a directly fired air heater of the non-premix type. The orifice openings are formed by radial slots in the periphery of a thin metal disc clamped between the end of a gas inlet pipe and a thicker metal disc member of special configuration. This specially configured disc member is larger in diameter than the gas inlet pipe and also larger in diameter than the slotted orifice disc. The portion of the member which is in contact with the slotted orifice disc is flat while the portion of the member larger than the slotted orifice disc is contoured outwardly in a convex manner. This convex surface by means of the Coanda effect causes the gas jets as emitted from the slotted orifice disc to flow into a conical shaped pattern and promotes the mixing of the gas with air and recirculated products of combustion.

3 Claims, 6 Drawing Figures

NON-PREMIX GAS BURNER ORIFICE

BACKGROUND OF THE INVENTION

1. Field of the Invention

This invention relates to the combustion of gaseous fuels and more particularly to the mixing of gaseous fuels with air and with products of combustion within a burner such as is used for the direct-fired heating of an airstream.

2. Description of the Prior Art

One of the problems and disadvantages of gas fired air heaters is that many of them are indirectly fired and therefore waste a large amount of heat which goes up the exhaust stack from the combustion chamber. In such indirectly fired heaters, the gas is burned within a combustion chamber which has metal walls and functions as a heater exchanger. The airstream to be heated is blown around these walls and heat exchanging surfaces and thus absorbs the heat therefrom. In this type of indirectly fired heater, the products of combustion, which might be noxious or irritating, are kept out of the airstream to be heated. While this does accomplish a great degree of safety, it does waste a lot of heat.

Where large volumes of air are to be heated and where the presence of products of combustion is not objectionable, the direct-fired type air heaters are used. In these heaters, the gas burners are simply placed in the airstream, and the products of combustion mix with the airstream. This type of heater finds application as makeup air heaters for large factories, crop driers, and for other type industrial drying purposes. Direct gas-fired air heaters do not waste much heat, but many of them do not mix the air with the incoming gaseous fuel as well as they should, and therefore the combustion is somewhat inefficient, as well as being more of a pollutant and safety hazard.

Direct gas-fired air heaters are generally of two types, premix and non-premix types. In the premix type, the gaseous fuel is mixed with primary combustion air and this mixture is blown into the burners for combustion. In burners of the non-premix type, the gaseous fuel is piped directly to the burner head where is is then mixed with a portion of the airstream, and this combustible mixture is then burned in the airstream.

Non-premix burner heads take a variety of forms, but the type which has a flame holder made of perforated metal, of some high temperature resistant material, contains the flame and creates the turbulence desired for mixing the combustion air with the gaseous fuel. Burners of this type usually have a plurality of small orifices so that the pressurized gas fuel enters the burner in a plurality of small jet streams which provide additional turbulent mixing and more efficient combustion of the fuel. When applying such a burner under conditions of different airstream volumes, or of different type fuel gases, such as butane or natural gas, it is often necessary to change the orifice size in order to maintain efficient operation. This not only involves a considerable amount of labor, but also necessitates having the desired size orifices at hand. Labor being as costly as it is today, this expense can be quite great, while keeping an inventory of different orifices on hand also can be fairly costly. Furthermore, keeping track of the supply of orifices requires further manpower and expense.

Known prior art patents which may be pertinent to this invention are listed as follows:

| | | |
|---|---|---|
| 794,225 | A. H. Humphrey | July 11, 1905 |
| 1,739,515 | J. F. Mustee | Dec. 17, 1929 |
| 1,766,803 | A. A. Scott et al | June 24, 1930 |
| 2,044,953 | H. R. Palmer | June 23, 1936 |
| 3,820,945 | Roger Vignes | June 28, 1974 |

None of the known devices teaches the new and novel structure as disclosed by the invention herein.

SUMMARY OF THE INVENTION

An object of the present invention is to provide a multiple-jet orifice disc for non-premix direct fired air heater burner heads in which the orifice disc and therefore the size of the orifice jets can be changed quickly and inexpensively.

Another object of this invention is to provide a device which will function in connection with a convexly contoured fluid flow member in association with the orifice disc to take advantage of what is known as the Coanda effect.

Another further object of this invention is to provide a burner head structure which is quickly changeable for various rates of burning and also which will be relatively inexpensive to produce, distribute and sell.

A still further object of this invention is to provide a gas burner structure of the non-premix type which will be more efficient in combustion as well as in heat transfer to the airstream associated therewith.

The device of the present invention provides a multiple-jet orifice for non-premix direct fired air heater burner heads in which the orifice size can be changed quickly and inexpensively. The part to be changed is a flat metal disc having radial slots evenly spaced about its periphery. Each slot forms an orifice the size of which is determined by the thickness of the disc and the width of the slot. It has been discovered through actual use that a limit to the minimum thickness of the disc of approximately 0.048 inch exists. That is, if the disc is made thinner than this, the efficient combustion and overall operation of the improved burner structure is materially affected. Therefore, where the orifice slots or the jets must be of relatively small size, this must be achieved by narrowing the width of the slot rather than by decreasing the thickness of the disc below the 0.048 inch value.

Also, as part of the present invention, the use of the orifice jet discs together with a gas flow member having a convexly contoured surface adjacent to and closely associated with the orifice jet disc produces further very beneficial effects due to the phenomenon known as the "Coanda effect". This effect is the tendency of a fluid jet to follow and adhere to an adjacent and parallel surface if the surface curves away from the axis of the jet. By using this effect with the burner structure of this invention, the gaseous fluid being emitted from the jet orifice disc will curve upwardly and outwardly from the vertical central burner structure and mix with the airstream and products of combustion for a much more efficient burning process and heat transfer process.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
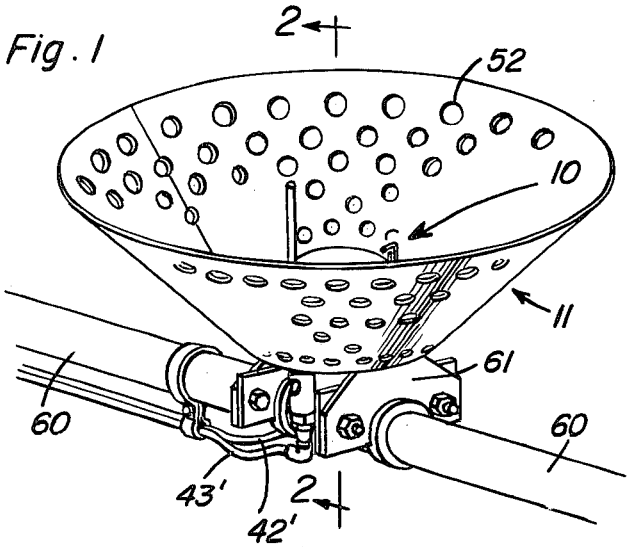
FIG. 1 is a perspective view of the gas burner structure of this invention.

Referring to FIG. 1 of the drawings, reference numeral 10 indicates the improved gas burner structure of this invention. Reference numeral 11 indicates in general a perforated stainless steel flame holder comprising a portion 12 which is in the shape of a frustum of a cone, and a flat central portion 13, best seen in FIG. 2. This structure is shown as being mounted upon a line or pipe 60 for feeding the gaseous fuel into the overall burner together with appropriate mounting brackets 61 and the necessary bolts and clamps as are needed to support the overall burner on the mounting or supporting structure.

Figure 4:
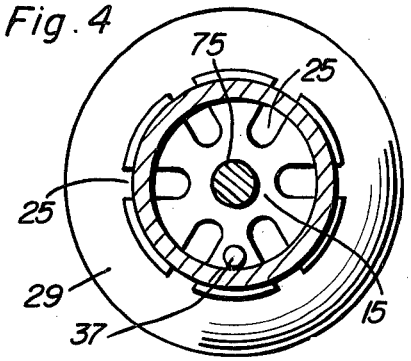
FIG. 4 is a bottom plan view of the orifice disc and the fluid flow disc member taken generally along line 4—4 of FIG. 3.
Figure 3:
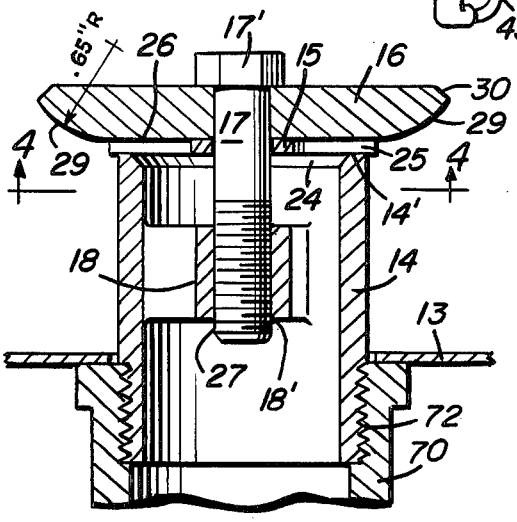
FIG. 3 is an enlarged view, partly in cross section, of the gas burner orifice structure per se as taken generally along line 3—3 of FIG. 2.
Figure 6:
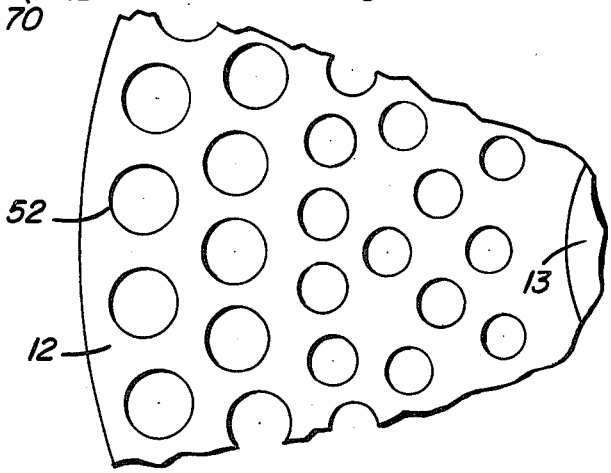
FIG. 6 is a plan view of a fragmentary portion of the burner cone.

The most essential parts of this burner device are the inlet pipe 14 for the gas to be burned, the slotted orifice disc 15, and the contoured disc member 16. These three primary components are best seen in the enlarged view of FIG. 3. A bolt 17 with an enlarged head 17', and screw threads 27, appropriately retain the parts in assembled relationship. Within the gas inlet pipe 14 is provided a cross-bar member 18 with appropriately tapped aperture 18' therethrough. The slotted orifice disc 15, best seen in FIGS. 4 and 5, has a plurality of smoothly contoured slots 25 provided equally around the circumference inwardly thereof. The upper end of the inlet pipe 14 has a beveled surface 24 provided thereon. The contoured disc member 16 has a central flat portion 26 of approximately the same diameter as that of disc 15. If the disc 16 were to have an entirely flat surface on the larger diameter portion adjacent to the slotted disc 15, the gas jets issuing from the slots 25 would flow in a flat radial pattern, and at high pressures would blow outwardly through the perforated flame holder 11. To correct this difficulty as well as producing other desirable benefits, a smoothly machined convex contour 29 is provided on the outer portion of disc member 16. The curve of this contour must be tangent to the flat inner portion 26 of the disc 16. The inner portion 26 should be equal in diameter to the slotted disc 15 with which it contacts. The slotted disc 15, in turn, is only slightly larger in diameter than the inlet pipe 14. It has been found in practice that a contour 29 for the member 16 of a cross-sectional radius of 0.65 inch performs very well. The diameter of the contour disc 16 should be such that a tangent to the contoured portion of the outer edge is roughly parallel to the conical flame holder 12. If the thickness of the contoured disc 16 requires it, conical portion 30 may be machined on the disc, each element of this conic frustum being perpendicular to the outer edge of the convex contour. Stated another way, the plane of the portion 30 should be approximately perpendicular to the cone 12. The purpose of this conical portion 30 is to reduce the diffusion of the jets.

From the above, one can see that gas entering through the inlet pipe 14 will exit through the orifices created by the slots 25 in the slotted disc 15, with the orifices being further defined or bounded by the smoothly machined end 14' of the inlet pipe 14, and the flat inner surface 26 of the contoured disc member 16. The beveled inner portion 24 of pipe 14 provides a funnel-shaped approach to the orifices. The area of each orifice is the product of the width of the slot 25 times the thickness of the slotted disc 15. One can readily see that the area of a plurality of orifices can be quickly and economically changed by the replacement of the one disc member, or by stacking several discs together. Disc member 15 may be inexpensively and quickly produced from stamped sheet metal with the entire structure being formed at one time. The minimum desirable thickness is 0.048 inches.

Figure 5:
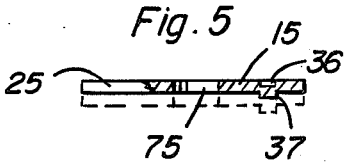
FIG. 5 is a center cross section of the orifice disc per se.

Referring to FIG. 5, the slotted disc 15 is shown per se. The slots 25 are uniformly disposed about the periphery thereof and extend radially inwardly far enough to facilitate entrance of the gas into the slots from the pipe 14. A hole 75 in the center permits the clamp screw 17 to pass therethrough and also center aligns the disc with the other parts. Also, in this Figure, which is a cross section through the center of the disc as viewed in FIG. 4, may be seen a circular depression 36 on one side of the disc with a corresponding protrusion 37 on the other side. These may be stamped simultaneously with the overall stamping of the disc. Both the protrusion and the recess or depression is slightly tapered so that the protrusion on one disc will fit into the depression of an adjacent disc, as indicated by the dotted line in FIG. 5. Thus, while the apertures 75 will align two or more of the discs with the other structure, as assembled, the protrusions 37 will when fitted into the depression of the adjacent disc align the slots 25 so that merely by combining several slotted discs 15, a thicker orifice member will be created without losing the angular alignment of the slots in the combined discs.

Figure 2:
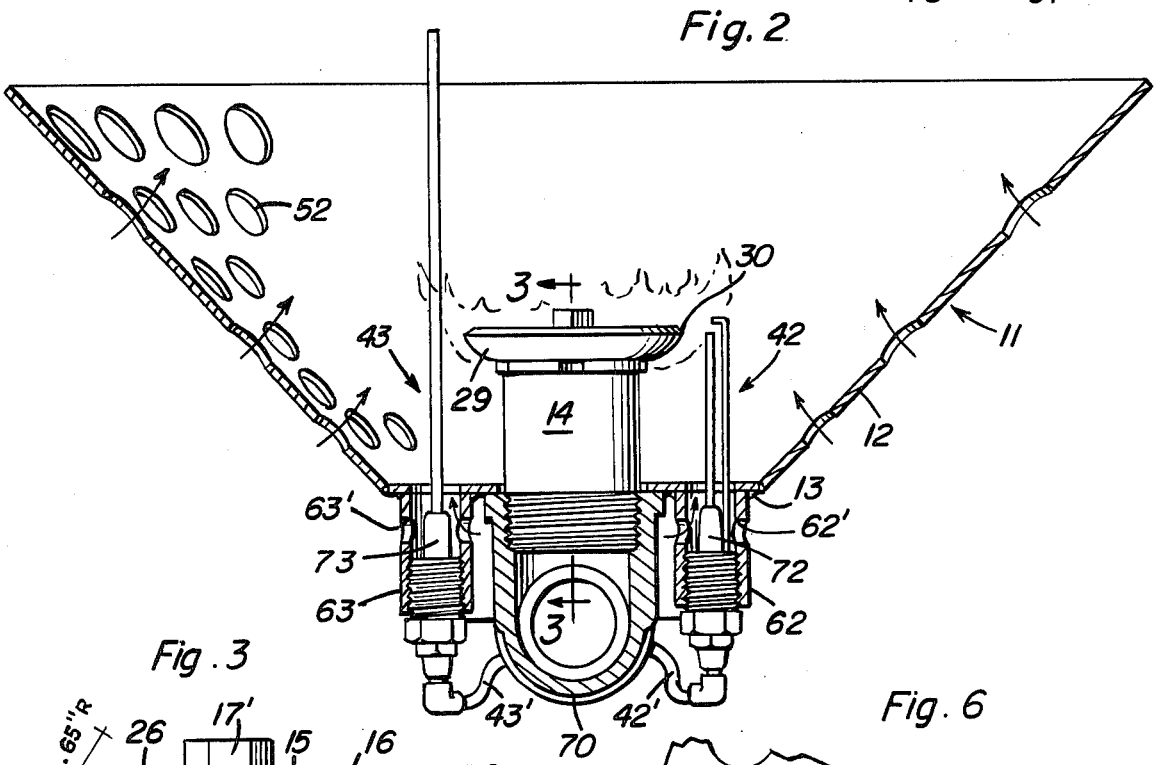
FIG. 2 is a view taken across the center of the device, partly in cross section, taken generally along line 2—2 of FIG. 1.

When the jets of gas issue from the substantially rectangular orifices 25, as perhaps is best seen in FIG. 2, they adhere to the contoured portion of the member 16 in accordance with the wall attachment effect described by Henri Coanda. Because of this effect, the gas jets as they leave the periphery of the contoured disc member 16 are deflected and flow outwardly and upwardly in a substantially conical pattern. While the jets are traveling across the convexed contoured portion 29, they produce a partial vacuum which draws in combustion air, as shown in small flow arrows in FIG. 2, through the apertures 52 in the flame holder cone 12, and also cause recirculation of the products of combustion within the flame holder. This induction of products of combustion into the fuel air mixture is very desirable for producing more efficient and complete combustion. While a conical cone-shaped flame member 11 is shown in FIGS. 1 and 2, obviously such flame holders may be elliptical shaped, or elongated trough-like in shape, and also a plurality of the basic jet structures 14, 15 and 16 may be provided for and with such flame holders. The single flame holder and burner structure is illustrated merely as an example, but this invention is not to be limited to such.

It has been discovered that it is not desirable to use discs 15 thinner than 0.048 inch with a .250 inch slot width. When it is necessary to reduce the orifice area below this size, it is necessary to narrow the slot width and use thicker or multiple discs. Very thin jets apparently diffuse too rapidly, and are not able to provide enough turbulent mixing. The chamfer or radius 24 on the inner lip of the inlet pipe 14 is very desirable to increase the discharge coefficient of the orifices. This may be done by metal machining or the like to eliminate any burrs, etc.

Also, the overall device normally will be provided with a spark igniter 42 connected by appropriate electric wiring 42' and mounted upon suitable holder structure 62 attached and associated with the base plate 13 of the flame holder. Similarly, a flame sensing electrode 43 is also provided and suitably connected by electric wiring 43' to the appropriate electrical circuitry in a conventional manner. Again, a suitable mounting structure 63 is provided on the base plate 13 of the flame holder for supporting this structure. The flame sensing member 43 may be used with any one of several commercially available flame safety devices which utilize the principal of flame conductivity or flame rectification in order to protect and indicate blowout of the burner flame or failure in operation of same. The spark igniter 42 is also used in a conventional manner with appropriate controls for igniting the burner emitted gas flow. Since clean air is drawn into the tubular mounting structures 62 and 63 through holes 62' and 63', the porcelain insulators 72 and 73 for the spark igniter 42 and the flame sensing electrode 43 are normally kept clean from carbon deposits thereon.

The conical portion 30 of approximately perpendicular plane to that of the inner cone 12 surface is also an important improvement with thin slotted discs in reducing the diffusion of the jet flow. Without this feature, diffusion of the jet flow with thin disc is not as good.

From the above description, one can readily visualize how simple and inexpensive the overall structure may be manufactured, distributed, and sold, and yet offer the very desirable features of quick and easy changing of jet orifice flow and burner flame size and control. Merely by changing the orifice slotted disc member 15, a wide range of burner head structures can be accommodated.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A gas burner device comprising; means for feeding gases to the device, means for emitting the gaseous fuel from the device prior to mixing with the air to support combustion, and means for causing the emitted gaseous fuel to form a conical-shaped pattern to promote the mixing of the gaseous fuel with the air for more efficient combustion, the means for emitting the gaseous fuel includes a changeable slotted disc associated with the means for feeding gaseous fuel to the device, the means for causing the emitted gaseous fuel to form a conical shaped flow path includes a second disc member with a rounded edge for effecting better mixing of the gaseous fuel with the air for more efficient combustion, said changeable slotted disc being completely flat and having a plurality of equally spaced slots extending inwardly from the circumference thereof, with the slots normally being wider than the thickness of the disc, the second disc member being substantially flat at the central portion thereof for close contact with the flat slotted disc, and the outer circumferential portion has a convex curvature which extends outwardly and away from the plane of the flat portion on the side in contact with the slotted disc.

2. The structure as set forth in claim 1, wherein the changeable slotted disc has a central aperture therethrough for mounting the disc to the means for feeding gaseous fuel to the device, and a depression and protrusion structure is provided with the disc for purposes of aligning several of said discs together with the slots in the same relative position so as to form a thicker gaseous fuel emitting structure.

3. The structure as set forth in claim 2, wherein the means for feeding gaseous fuel to the device includes a pipe member, supporting structure provided inside of the pipe member for receiving attachment means for holding the slotted disc and contoured member together adjacent the outlet of the pipe, and means provided inside of the pipe outlet to permit a better more efficient flow of the gaseous fuel.

* * * * *